United States Patent [19]

Knorr et al.

[11] Patent Number: 4,605,532

[45] Date of Patent: Aug. 12, 1986

[54] COPPER ALLOYS HAVING AN IMPROVED COMBINATION OF STRENGTH AND CONDUCTIVITY

[75] Inventors: David B. Knorr, Hamden; John F. Breedis, Trumbull, both of Conn.

[73] Assignee: Olin Corporation, New Haven, Conn.

[21] Appl. No.: 740,388

[22] Filed: Jun. 3, 1985

Related U.S. Application Data

[63] Continuation-in-part of Ser. No. 645,957, Aug. 31, 1984, abandoned.

[51] Int. Cl.[4] ..... C22C 9/02

[52] U.S. Cl. ..... 420/472; 148/11.5 C; 148/412; 148/432; 420/496

[58] Field of Search ..... 148/11.5 C, 12.7 C, 148/411, 412, 432; 420/499, 494, 472, 473, 487, 496

[56] References Cited

U.S. PATENT DOCUMENTS

| | | | |
|---|---|---|---|
| 2,123,628 | 7/1938 | Hensel et al. | 420/472 |
| 2,128,955 | 9/1938 | Montgomery | 420/472 |
| 2,157,934 | 5/1939 | Hensel et al. | 148/412 |
| 3,039,867 | 6/1962 | McLain | 148/12.7 C |
| 3,522,039 | 7/1970 | McLain | 148/432 |
| 3,522,112 | 7/1970 | McLain | 420/472 |
| 3,573,110 | 3/1971 | Ence | 148/411 |
| 3,639,119 | 2/1972 | McLain | 148/11.52 |
| 3,640,779 | 2/1972 | Ence | 148/411 |
| 3,677,745 | 2/1969 | Finlay et al. | 148/12.7 C |
| 3,698,965 | 10/1972 | Ence | 148/411 |
| 3,778,318 | 12/1973 | Finlay et al. | 148/12.7 C |
| 3,976,477 | 8/1976 | Crane et al. | 420/499 |
| 4,202,688 | 5/1980 | Crane et al. | 148/11.5 C |
| 4,305,762 | 12/1981 | Caron et al. | 148/11.5 C |
| 4,466,939 | 8/1984 | Kim et al. | 420/487 |

FOREIGN PATENT DOCUMENTS

| | | | |
|---|---|---|---|
| 577850 | 6/1969 | Canada . | |
| 915392 | 7/1949 | Fed. Rep. of Germany . | |
| 0079848 | 6/1980 | Japan | 148/12.7 C |
| 0154540 | 12/1980 | Japan | 148/12.7 C |
| 0105645 | 8/1981 | Japan | 420/496 |
| 0053057 | 11/1983 | Japan | 420/472 |
| 0199835 | 11/1983 | Japan | 420/472 |
| 0009141 | 1/1984 | Japan | 420/472 |

*Primary Examiner*—Melvyn J. Andrews
*Assistant Examiner*—S. Kastler
*Attorney, Agent, or Firm*—Paul Weinstein; Howard M. Cohn; Barry L. Kelmachter

[57] ABSTRACT

A copper base alloy having an improved combination of conductivity and strength for applications such as lead frames or electrical connectors. The alloys consists essentially of from about 0.3 to 1.6% by weight iron, with up to one-half the iron content being replaced by nickel, manganese, cobalt, and mixtures thereof; from about 0.01 to about 0.20% by weight magnesium; from about 0.10 to about 0.40% by weight phosphorus; up to about 0.5% by weight tin or antimony and mixtures thereof; and the balance copper. The phosphorus to magnesium ratio and phosphorus to the total content of phosphide formers ratio are maintained within critical limits.

25 Claims, 6 Drawing Figures

COPPER ALLOYS HAVING AN IMPROVED COMBINATION OF STRENGTH AND CONDUCTIVITY

This application is a continuation-in-part of Ser. No. 645,957, filed Aug. 31, 1984 by David B. Knorr et al. for "Copper Alloys Having An Improved Combination of Strength and Conductivity" now abandoned.

This invention relates to copper base alloys having particular application in the electronics industry as lead frame materials or connector materials. The electronics industry is demanding increasingly higher strength lead frame alloys with high electrical and thermal conductivities. Likewise, connector applications would benefit from such alloys. The alloys of the present invention provide a combination of strength and conductivity properties which are improved as compared to alternative commercially available alloys.

High copper alloys (96 to 99.3% copper) are used in electronic and electrical applications because of their high strength relative to copper and their moderate to high electrical and thermal conductivities. Within this group of alloys, electrical conductivity typically ranges from as high as 90% IACS for copper alloys C18200 and C16200, to as low as 22% IACS for copper alloys C17000 and C17200. Alloys strengthened by phosphides typically have intermediate to high conductivities, for example, nickel-phosphide strengthened alloys C19000, iron-phosphide strengthened alloys C19200, C19400 and C19600 and mixed iron and cobalt-phosphides as in alloys C19500. Alloys C19200 and C19600 have nominally 1% iron but differ in their phosphorus contents which nominally comprise 0.03 and 0.3%, respectively. Another alloy C19520, which is foreign produced and sold as TAMAC-5, contains 0.5 to 1.5% iron, 0.01 to 0.35% phosphorus and 0.5 to 1.5% tin.

The following patents are illustrative of phosphide strengthened alloys: U.S. Pat. Nos. 2,123,628, 3,039,867, 3,522,039, 3,639,119, 3,640,779, 3,698,965 and 3,976,477, German Pat. No. 915,392, Canadian Pat. No. 577,850 and Japanese Nos. 56-105645, 55-154540, 58-53057, 55-79848 and 59-9141. U.S. Pat. Nos. 3,522,112 and 3,573,110 are illustrative of the processing of such alloys.

Magnesium-phosphide has also been found to strengthen copper alloys as in C15500. This alloy is embraced by the disclosures of U.S. Pat. Nos. 3,677,745 and 3,778,318. The alloys and process disclosed in these patents are claimed to have a ratio of phosphorus to magnesium ranging from 0.3 to 1.4. The alloys are disclosed to broadly contain 0.002 to 4.25% phosphorus and 0.01 to 5.0% magnesium with the balance apart from impurities comprising copper. The alloys can also contain 0.02 to 0.2% silver and from 0.01 to 2.0% cadmium. Magnesium-phosphide as a strengthener has also been employed in the alloys of U.S. Pat. Nos. 4,202,688 and 4,305,762. The former patent discloses an alloy containing mischmetal, phosphorus and magnesium. The latter patent discloses an alloy containing 0.04 to 0.2% of each of magnesium, phosphorus and a transition element selected from iron, cobalt, nickel and mixtures thereof.

In U.S. Pat. No. 2,157,934 there is disclosed a copper alloy comprising 0.1 to 3% magnesium, 0.1 to 5% of a material from the group nickel, cobalt, iron, 0.1 to 3% silicon and the balance copper. The patent also indicates that it is possible to improve the alloys by adding small percentages of additional ingredients such as silver, zinc, cadmium, tin, zirconium, calcium, lithium, titanium and manganese. It also states "In some instances, phosphorus, aluminum or beryllium may be substituted, in whole or in part, for the silicon since they also form intermetallic compounds with the iron group metals.". Japanese No. 58-199835 discloses a copper alloy containing Mg 0.03–0.3%, Fe 0.03–0.3%, P 0.1–0.3%, balance Cu.

In accordance with the present invention, an improved copper base alloy having a combination of high strength and high conductivity along with excellent softening resistance and formability is provided. The alloy contains a mixture of phosphides comprising magnesium-phosphide and phosphides of iron with or without nickel, manganese, cobalt or mixtures thereof.

In accordance with this invention, the ratio of magnesium to phosphorus and the ratio of the total content of phosphide formers (magnesium+iron+nickel+manganese+cobalt) to phosphorus must each be maintained within critical limits in order to achieve the desired high conductivity. It has surprisingly been found that certain solid solution strengthening elements such as tin or antimony can beneficially increase the strength of the alloy with some loss of conductivity while other elements such as aluminum and chromium have a negative impact on both strength and conductivity and silicon has an extremely negative effect on conductivity.

The alloys of the present invention consist essentially of from about 0.3 to about 1.6% by weight iron, with up to one-half the iron content being replaced by an element selected from the group consisting of nickel, manganese, cobalt, and mixtures thereof; from about 0.01 to about 0.20% by weight magnesium; from about 0.10 to about 0.40% by weight phosphorus; up to about 0.5% by weight of an element selected from the group consisting of tin, antimony, and mixtures thereof; and the balance copper, with the proviso that the phosphorus to magnesium ratio comprises at least about 1.5 and that the ratio of phosphorus to the total content of phosphide formers (magnesium+iron+nickel+manganese+cobalt) ranges from about 0.22 to about 0.49. Preferably, the phosphorus to magnesium ratio comprises at least about 2.5 and the minimum iron content is greater than 0.3% by weight such as at least 0.35% or at least 0.4% by weight.

Preferably, the alloy consists essentially of from about 0.5 to about 1.0% by weight iron with up to one-half the iron content being replaced by an element selected from the group consisting of nickel, manganese, cobalt and mixtures thereof; from about 0.15 to about 0.25% by weight phosphorus; from about 0.02 to about 0.1% by weight magnesium; up to about 0.35% by weight of an element selected from the group consisting of tin, antimony and mixtures thereof; and the balance copper, with the proviso that the ratio of phosphorus to magnesium ranges from about 2.5 to about 8.0 and that the ratio of phosphorus to the total content of phosphide formers ranges from about 0.25 to about 0.44. In some cases, the upper limit for the phosphorus to magnesium ratio can be increased to 12, however, most preferably, that ratio ranges from about 3.0 to about 6.0.

In accordance with an alternative embodiment of the present invention, the alloys preferably contain a necessary addition of tin for increasing their strength. For the alloys of this embodiment, the tin content which is indicated to be optional in the above noted ranges comprises instead an effective amount of tin for increasing the strength of the alloy up to about 0.4% by weight with the ranges for all other alloying elements being the same as set forth above in the broadest embodiment. The ratio of phosphorus to the total content of phosphide formers changes to from about 0.24 to about 0.48. In some cases, the lower limit for the ratios of phosphorus to the total content of phosphide formers can be reduced to 0.22. Preferably, the tin range in accordance with this embodiment comprises from about 0.05 to about 0.35% by weight tin with the ranges of all other elements being the same as set forth above for the preferred alloy. It has surprisingly been found that for the alloys of this preferred embodiment that the ratio of phosphorus to the total content of phosphide formers changes in a critical fashion so that it ranges from about 0.27 to about 0.39. Accordingly, it is an advantage of the present invention to provide an improved copper base alloy for electronics applications such as lead frames or connectors.

It is a further advantage of this invention to provide such an alloy having improved strength while maintaining adequate conductivity and formability for such applications.

These and other advantages will become more apparent from the following description and drawings.

Figure 1:
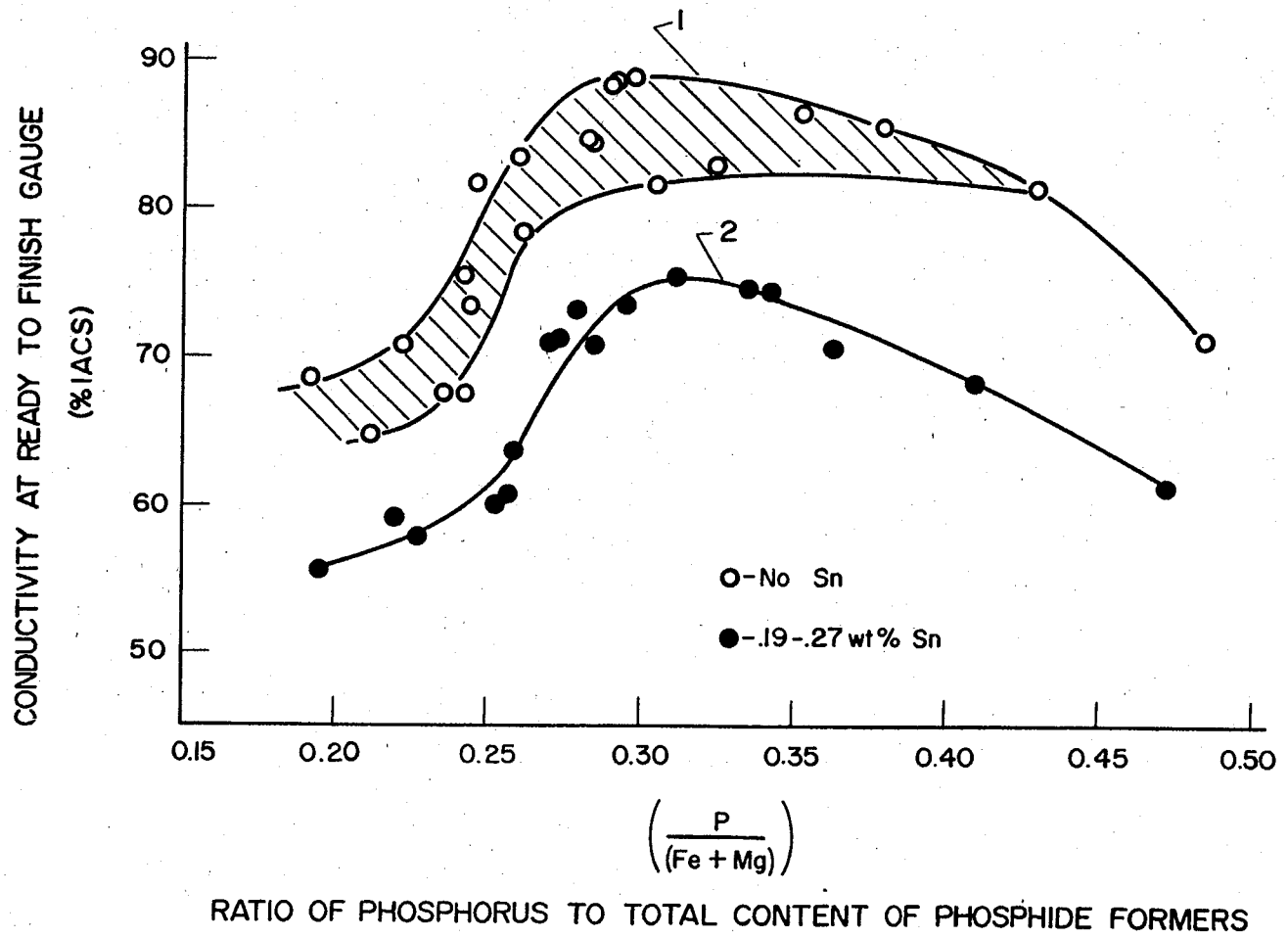
FIG. 1 is a graph showing the relationship between conductivity and the ratio of phosphorus to the total content of phosphide formers.

In accordance with the present invention an improved copper base alloy is provided which has a combination of high strength and high conductivity along with excellent softening resistance and formability. The alloys consist essentially of from about 0.3 to about 1.6% by weight iron, with up to one-half the iron content being replaced by an element selected from the group consisting of nickel, manganese, cobalt and mixtures thereof; from about 0.01 to about 0.20% by weight magnesium; from about 0.10 to about 0.40% by weight phosphorus; up to about 0.5% by weight of an element selected from the group consisting of tin, antimony, and mixtures thereof; and the balance copper; with the proviso that the phosphorus to magnesium ratio comprises at least about 1.5 and that the ratio of phosphorus to the total content of phosphide formers (magnesium+iron+nickel+manganese+cobalt) ranges from about 0.22 to about 0.49. Preferably, the phosphorus to magnesium ratio comprises at least about 2.5 and the minimum iron content is greater than 0.3% by weight, such as at least 0.35% or at least 0.40% by weight.

Preferably, the alloys consist essentially of from about 0.5 to about 1.0% by weight iron, with up to one-half the iron content being replaced by an element selected from the group consisting of nickel, manganese, cobalt and mixtures thereof; from about 0.15 to about 0.25% by weight phosphorus; from about 0.02 to about 0.1% by weight magnesium; up to about 0.35% by weight of an element selected from the group consisting of tin, antimony, and mixtures thereof; and the balance copper; with the proviso that the phosphorus to magnesium ratio ranges from about 2.5 to about 8.0 and that the ratio of phosphorus to the total content of phosphide formers ranges from about 0.25 to about 0.44 and most preferably from about 0.27 to about 0.38. In some cases, the upper limit for the phosphorus to magnesium ratio can be increased to 12, however, most preferably, that ratio ranges from about 3.0 to about 6.0.

The alloys of the present invention may also contain other elements and impurities which do not substantially degrade their properties.

In accordance with an alternative embodiment of the present invention, the alloys preferably contain a necessary addition of tin for increasing their strength. For the alloys of this embodiment, the tin content which is indicated to be optional in the above noted ranges comprises instead a necessary addition. The alloys of the alternative embodiment consist essentially of from about 0.3 to about 1.6% by weight iron, with up to one-half the iron content being replaced by an element selected from the group consisting of nickel, manganese, cobalt and mixtures thereof; from about 0.01 to about 0.20% by weight magnesium; from about 0.10 to about 0.40% by weight phosphorus; an effective amount of tin for increasing the strength of the alloy up to about 0.4% by weight; up to about 0.5% by weight antimony; and the balance copper; with the proviso that the phosphorus to magnesium ratio comprises at least about 1.5 and that the ratio of phosphorus to the total content of phosphide formers (magnesium+iron+nickel+manganese+cobalt) shall be in the range of from about 0.24 to about 0.48. In some cases, the lower limit for the ratio of phosphorus to the total content of phosphide formers can be reduced to 0.22.

Preferably, the alloys of the alternative embodiment consist essentially of from about 0.5 to about 1.0% by weight iron with up to one-half the iron content being replaced by an element selected from the group consisting of nickel, manganese, cobalt and mixtures thereof; from about 0.15 to about 0.25% by weight phosphorus; from about 0.02 to about 0.1% by weight magnesium; from about 0.05 to about 0.35% by weight tin; up to about 0.35% by weight antimony; and the balance copper; with the proviso that the phosphorus to magnesium ratio ranges from about 2.5 to about 8.0 and that the ratio of phosphorus to the total content of phosphide formers ranges from about 0.27 to about 0.39 and most preferably from about 0.28 to about 0.37.

It has surprisingly been found that for the alloys of this alternative embodiment preferably the ratio of phosphorus to the total content of phosphide formers changes as compared to the tin free alloy. The alloys of the alternative embodiment may also contain other elements and impurities which do not substantially degrade their properties.

Reducing the phosphorus below the limits set forth herein reduces the strength of the alloy. Increasing the phosphorus above the limits set forth herein can cause processing difficulties including cracking during casting and hot rolling and otherwise impairs surface quality. Magnesium below the limits set forth herein reduces the alloy's strength. Magnesium above the limits set forth herein adversely affects the alloys conductivity and at very high magnesium contents its hot rollability. If the content of iron, with or without nickel, manganese or cobalt, is below the limits set forth herein the strength of the alloy is adversely affected and if the limits herein are exceeded, then the alloy becomes difficult to process due to cracking during casting and hot rolling and has impaired surface quality.

In addition to the foregoing, in the alternative embodiment of this invention, contents of tin higher than those set forth herein result in severe loss of conductivity and reduced bend formability. Contents of tin below the limits set forth herein result in reduced strength.

If the ratios of phosphorus to magnesium and phosphorus to the total content of phosphide formers are not within the ranges set forth herein, then the conductivity of the alloy is adversely impacted. The ranges of these ratios are believed to be critical as shown in FIG. 1. In FIG. 1 the upper band 1 and the curve 2 are plots of the ratio of phosphorus to the total content of phosphide formers versus conductivity for a series of alloys with and without tin. The plots set forth therein clearly show an unexpected and surprising criticality for this ratio with respect to the conductivity of the resultant alloy. The upper band 1 is for an alloy containing no tin. The lower curve 2 is for an alloy containing tin within the ranges of this invention. It is apparent from a consideration of the respective plots that tin increases the strength of the alloy at some reduction in conductivity. It is surprising that the preferred range of this ratio for the tin containing alloy is narrower than the range for this ratio for the alloy without tin.

The alloys of the present invention are believed to contain a mixture of phosphides comprising magnesium-phosphide particles and phosphide particles of iron with or without nickel, manganese, cobalt or mixtures thereof. The microstructure consists of some large 1 to 3 micron phosphide particles and a uniform dispersion of fine phosphide particles of less than about 0.5 microns in size. As noted, the phosphides are compounds containing magnesium or iron. Where other elements selected from the group consisting of nickel, manganese, cobalt and mixtures thereof substitute for part of the iron, it is believed that the magnesium-phosphide is unchanged but the iron-phosphide includes whatever element is added.

Tin or antimony, when present in the alloys of this invention, comprise solid solution strengtheners which remain dissolved in the copper matrix to strengthen the alloy, but as will be shown hereafter, at some reduction in conductivity. It is believed that the formation of at least two phosphide compounds in the alloys of the present invention allows them to achieve properties that exceed those properties which would be obtained if either compound alone was present.

It has surprisingly been found that elements such as aluminum and chromium have an adverse impact on both the strength and conductivity of the alloy. For example, the adverse impact was shown when aluminum was present in an amount from about 0.2 to about 0.25% or when chromium was present in an amount from 0.4 to 0.5%. It has also surprisingly been found that an amount of silicon in the range of 0.2 to 0.25% very adversely affected the conductivity of the alloy while providing a minor increase in strength.

The alloys of the present invention provide good solderability and have softening resistance superior to Alloy C19400 and almost as good as Alloy C19500.

Figure 2:
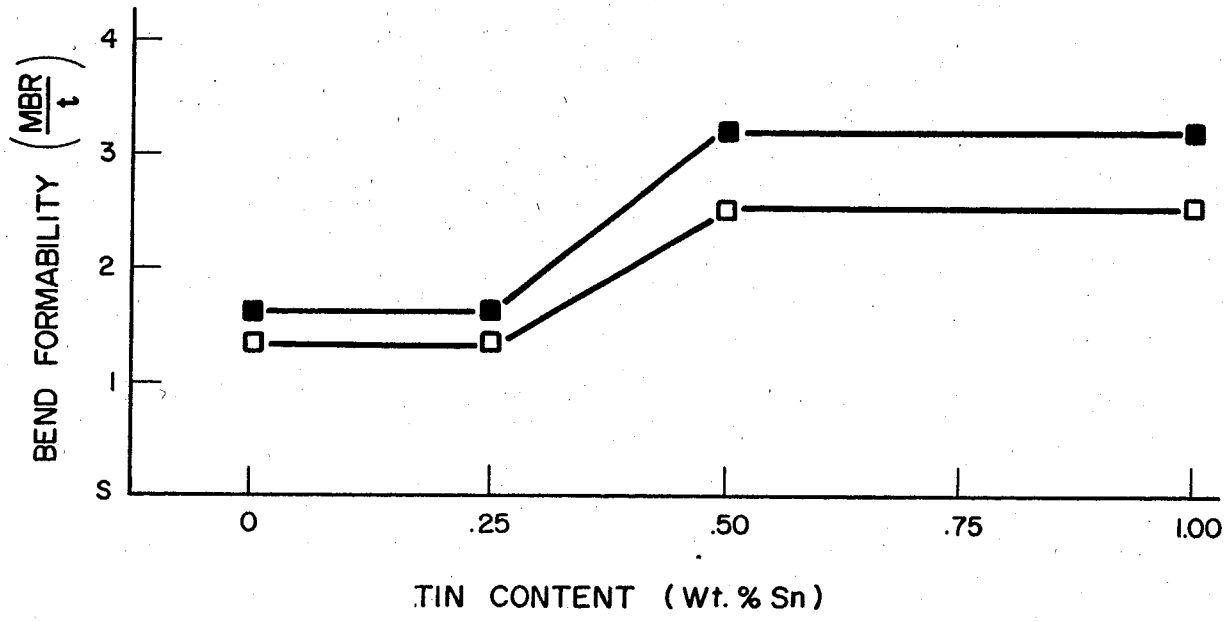
FIG. 2 is a graph showing the relationship between bend formability and the percentage of tin in the alloy.

FIG. 2 is a plot of minimum bend radius divided by thickness versus weight percent tin. The bend formability test measures the minimum radius that a strip can be bent 90° without cracking. The good way bend properties are measured with the bend axis perpendicular to the rolling direction. While the bad way are measured with the bend axis parallel to the rolling direction. The minimum bend radius (MBR) is the smallest die radius about which the strip can be bent 90° without cracking and "t" is the thickness of the strip. In FIG. 2, the upper curve is for bad way or transverse orientation bends while the lower curve is for good way or longitudinal orientation bends.

When tin is present in the alloys of this invention, it has surprisingly been found, as shown in FIG. 2, that tin should be limited to less than 0.4% by weight and, preferably, less than 0.3% by weight where good bend formability is desired. Higher contents of tin, as shown in FIG. 2, adversely affect the bend formability of the alloy.

The alloys of the present invention may be processed in accordance with the following process. The alloys are preferably direct chill cast from a temperature of at least about 1100° to about 1250° C. It has been found that the alloys of this invention may be susceptible to grain boundary cracking during cooling of the ingot bar. Accordingly, particularly for large section castings, it is preferred to control the post solidification cooling in a manner to reduce the cooling rate from the normal DC casting cooling rate. The particular method for casting the alloys does not form part of the present invention.

The resulting cast ingots are homogenized at a temperature of from about 850° to about 980° C. for about one-half to about 4 hours, followed by hot working such as by hot rolling in a plurality of passes to a desired gauge generally less than about ¾". Optionally, the alloys may be resolutionized to solutionize precipitated alloying elements by holding the alloys in a furnace at a temperature of from about 900° to about 980° C. followed by rapid cooling, such as by water quenching.

The alloys with or without resolutionization are preferably milled to remove oxide scale and then cold worked as by cold-rolling to an intermediate gauge with from about 10 to about 90% reduction in thickness and, preferably, from about 30 to about 80% reduction. The cold rolling is preferably followed by annealing for an effective period of time to soften the alloy up to about 6 hours at a metal temperature of from about 400° to about 800° C. Strip anneals employ higher temperatures within these ranges for shorter periods; whereas, Bell anneals employ lower temperatures for longer periods.

The alloys are then preferably cold worked again as by cold rolling to a ready to finish gauge with about 10 to about 90% reduction in thickness and, preferably, from about 20 to about 80% reduction. The alloys are then preferably annealed for from about 1 to about 6 hours at a temperature of from about 350° to about 550° C. This anneal is preferably a Bell anneal. The alloys may then be rolled to a finished temper as desired with from about 20 to about 80% reduction in thickness. The alloys may be stress relief annealed, if desired.

It has been found that the anneals at the intermediate and ready to finish gauges can be controlled in a manner so as to give either full recrystallization or partial recrystallization. Partial recrystallization has been found to be a useful way of increasing the relative strength of the alloy from about 5 to about 10 ksi in yield strength with a small reduction in bend formability. It has been found that partial recrystallization of the alloys of this invention comprising from about 10 to about 80% recrystallization can be achieved by intermediate gauge annealing at a temperature range of from about 425° to about 500° C. and by ready to finish gauge annealing at a temperature range from about 375° to about 475° C.

The present invention will be more readily understandable from a consideration of the following illustrative examples.

EXAMPLE I

The example alloys were air melted with a charcoal cover and Durville cast to yield twelve pound ingots 6"×4"×1¾". The casting temperature was about 1125° to about 1150° C. The resulting ingots were homogenized at about 850° to 900° C. for 2 hours, then rolled from 1¾" to 0.4" in seven passes with no reheating. To resolutionize the precipitated alloying elements, the strips were returned to the furnace and held at about 850° to 900° C. for about 1 hour and then water quenched. The strips were then milled to remove oxide scale and cold rolled to 0.080". The cold rolled strips were then annealed for 2 hours at about 500° to about 575° C. The material was then cold rolled to 0.040", annealed at about 450° to 500° C. for about 2 hours and then measured for electrical conductivity. The material was then finally rolled to 0.010" gauge for property measurements. Softening resistance was determined by annealing samples of material at 0.010" gauge for 1 hour at various temperatures between 300° and 550° C. followed by measuring the respective Vicker's hardness values.

Two alloys whose compositions are listed in Table 1A were processed as described above. Alloy 3 in Table 1A corresponds to commercial Alloy C19600. The three alloys are compared to other commercial Alloys C19400, C19500 and C19520 in Table 1B. Properties for C19400 are for material in the Spring Temper with a final relief anneal while properties for C19500 are for the ¾ Hard Temper. These particular tempers for these commercial alloys are those commonly specified for lead frame applications. The electrical conductivity values, tensile properties and bend formability properties are listed.

Clearly, the alloys of this invention represent improvements over available commercial alloys. Alloy 1 of this invention offers somewhat better strength and substantially better conductivity compared to copper Alloy C19400. The addition of magnesium results in much better strength at similar conductivity as shown by comparing Alloy 1 to Alloy 3. Alloy 2, in accordance with the alternative embodiment of this invention, offers substantially better conductivity at similar strength compared to copper Alloy C19500. All comparisons are based on generally similar bend formability properties.

TABLE 1A

| | | |
|---|---|---|
| Alloy 1 | Iron | 1.00% |
| | Magnesium | 0.13% |
| | Phosphorus | 0.32% |
| | Copper | Balance |
| Alloy 2 | Iron | 0.99% |
| | Magnesium | 0.13% |
| | Phosphorus | 0.33% |
| | Tin | 0.25% |
| | Copper | Balance |
| Alloy 3 | Iron | 1.10% |
| | Phosphorus | 0.27% |
| | Copper | Balance |

TABLE 1B

| Alloy | Electrical Conductivity % IACS | Properties at 0.010" 0.2% Yield Strength ksi | Tensile Strength ksi | Tensile Elong. % | Longitudinal MBR/t | Transverse MBR/t |
|---|---|---|---|---|---|---|
| 1 | 78.5 | 75 | 77 | 1.7 | 1.2 | 1.6 |
| 2 | 67.5 | 80 | 82 | 1.5 | 1.2 | 1.6 |
| 3 | 75.9 | 72 | 74 | 1.5 | 1.2 | 1.6 |
| C19400 | 69 | 70 | 73 | 1.5 | 1.2 | 1.6 |
| C19500 | 59 | 80 | 82 | 2.2 | 1.2 | 1.6 |
| C19520 | 48 | 63 | 74 | 10.0 | 0.8 | 1.6 |

EXAMPLE II

Alloys whose compositions are listed in Table 2A are compared with Alloy 1 in Table 2B. The alloys were processed as described previously with reference to Example I. The results shown in Table 2B are similar to those previously shown except that annealed conductivity at 0.040" gauge is used. The data in Table 2B shows that the enhanced properties of this invention are retained when nickel, cobalt or manganese are substituted in part for iron in the alloy.

TABLE 2A

| | | |
|---|---|---|
| Alloy 4 | Iron | 0.67% |
| | Nickel | 0.30% |
| | Phosphorus | 0.25% |
| | Magnesium | 0.09% |
| | Copper | Balance |
| Alloy 5 | Iron | 0.57% |
| | Nickel | 0.53% |
| | Phosphorus | 0.36% |
| | Magnesium | 0.12% |
| | Copper | Balance |
| Alloy 6 | Iron | 0.68% |
| | Manganese | 0.33% |
| | Phosphorus | 0.29% |
| | Magnesium | 0.10% |
| | Copper | Balance |
| Alloy 7 | Iron | 0.72% |
| | Nickel | 0.29% |
| | Phosphorus | 0.31% |
| | Magnesium | 0.11% |
| | Tin | 0.25% |
| | Copper | Balance |
| Alloy 7a | Iron | 0.73% |
| | Cobalt | 0.31% |
| | Phosphorus | 0.305% |
| | Magnesium | 0.096% |
| | Tin | 0.27% |
| | Copper | Balance |

TABLE 2B

| Alloy | Electrical Conductivity Annealed at 0.040" % IACS | Properties at 0.010" 0.2% Yield Strength ksi | Tensile Strength ksi | Tensile Elong. % | Longitudinal MBR/t | Transverse MBR/t |
|---|---|---|---|---|---|---|
| 1 | 84.4 | 75 | 77 | 1.7 | 1.2 | 1.6 |

TABLE 2B-continued

| Alloy | Electrical Conductivity Annealed at 0.040" % IACS | Properties at 0.010" 0.2% Yield Strength ksi | Tensile Strength ksi | Tensile Elong. % | Longi-tudinal MBR/t | Trans-verse MBR/t |
|---|---|---|---|---|---|---|
| 4 | 84.7 | 77 | 80 | 2.2 | 1.6 | 1.6 |
| 5 | 78.8 | 80 | 82 | 1.5 | 1.6 | 1.6 |
| 6 | 76.2 | 76 | 79 | 2.2 | 1.6 | 1.6 |
| 7 | 73.5 | 80 | 83 | 1.7 | 1.6 | 1.6 |
| 7a | 70.2 | 84 | 86 | 2.2 | 1.6 | 1.6 |

EXAMPLE III

The effect of tin or antimony additions as set forth in the alloys in Table 3A are shown by annealed conductivity at 0.040" gauge and tensile properties at 0.010" gauge. All of the alloys were processed essentially in the manner described with reference to Example I. It is apparent from a consideration of the results in Table 3B that tin within the range of the present invention provides higher strength with an acceptable loss of conductivity. However, exceeding the range of tin in accordance with the alternative embodiment of this invention has a substantial deleterious effect on conductivity.

TABLE 3A

| | | |
|---|---|---|
| Alloy 8 | Iron | 1.09% |
| | Magnesium | 0.13% |
| | Phosphorus | 0.37% |
| | Tin | 0.50% |
| | Copper | Balance |
| Alloy 9 | Iron | 1.05% |
| | Magnesium | 0.12% |
| | Phosphorus | 0.37% |
| | Tin | 1.00% |
| | Copper | Balance |
| Alloy 10 | Iron | 1.02% |
| | Magnesium | 0.11% |
| | Phosphorus | 0.36% |
| | Antimony | 0.28% |
| | Copper | Balance |

TABLE 3B

| Alloy | Annealed at 0.040" % IACS | 0.2 Y.S. ksi | Properties at 0.010" Tensile Strength ksi | Tensile Elongation % |
|---|---|---|---|---|
| 1 | 84.4 | 75 | 77 | 1.7 |
| 2 | 73.5 | 80 | 82 | 1.5 |
| 8 | 58.3 | 89 | 91 | 1.7 |
| 9 | 47.0 | 94 | 97 | 2.0 |
| 10 | 71.3 | 85 | 87 | 1.5 |

EXAMPLE IV

This example compares the softening resistance of several alloys of this invention as previously described in the aforenoted examples to commercial alloys. All of the alloys were processed as described by reference to Example I and their properties have previously been shown in Tables 1B and 2B. The results of the softening resistance test are set forth in Table 4. The data in Table 4 show that the softening resistance of the alloys of this invention are improved compared to copper Alloy C19400 and approach that of copper Alloy C19500.

TABLE 4

| Treatment | Softening Data at 0.010" Vicker's Hardness (DPH-2.5 kg) Alloy 1 | Alloy 2 | Alloy 7 | C19400 | C19500 |
|---|---|---|---|---|---|
| As-received | 179 | 190 | 186 | 168 | 189 |
| 300° C./1 hr | 170 | 188 | 183 | 168 | 190 |
| 350° C./1 hr | 166 | 177 | 183 | 170 | — |
| 375° C./1 hr | 162 | 162 | 174 | — | — |
| 400° C./1 hr | 118 | 135 | 145 | 73 | 167 |
| 425° C./1 hr | 106 | 114 | 117 | — | — |
| 450° C./1 hr | 100 | 109 | 116 | 74 | 94 |
| 500° C./1 hr | 96.5 | 107 | 106 | 81 | 97 |
| 550° C./1 hr | 96.5 | 106 | 101 | 72 | 94 |

EXAMPLE V

This example compares the alloys with iron and various phosphorus to magnesium ratios. Alloys which are listed in Table 5A were processed as described previously except that Alloys 12 and 14 received a 50% final cold rolling reduction to reach 0.010" gauge. The resultant properties of the alloys are set forth in Table 5B. It is apparent that the alloys of the present invention having phosphorus to magnesium ratios exceeding 1.4 have better combinations of electrical conductivity and strength.

TABLE 5A

| | | |
|---|---|---|
| Alloy 11 | Iron | 0.58% |
| | Magnesium | 0.19% |
| | Phosphorus | 0.22% |
| | Copper | Balance |
| Alloy 12 | Iron | 0.71% |
| | Magnesium | 0.30% |
| | Phosphorus | 0.25% |
| | Copper | Balance |
| Alloy 13 | Iron | 1.12% |
| | Magnesium | 0.06% |
| | Phosphorus | 0.29% |
| | Copper | Balance |
| Alloy 14 | Iron | 0.88% |
| | Magnesium | 0.26% |
| | Phosphorus | 0.36% |
| | Copper | Balance |

TABLE 5B

| Alloy | P/Mg Ratio | Electrical Conductivity Annealed at 0.040" % IACS | Properties at 0.10 inch 0.2% Yield Strength ksi | Tensile Strength ksi | Tensile Elong. % | Longi-tudinal MBR/t | Trans-verse MBR/t |
|---|---|---|---|---|---|---|---|
| 12 | 0.8 | 65.6 | 79 | 81 | 1.0 | 0.8 | 1.6 |
| 11 | 1.2 | 77.0 | 79 | 80 | 3.0 | 0.4 | 1.6 |
| 14 | 1.4 | 72.2 | 79 | 81 | 1.5 | 1.6 | 1.6 |
| 1 | 2.5 | 84.4 | 74 | 77 | 1.7 | 1.2 | 1.6 |

TABLE 5B-continued

| Alloy | P/Mg Ratio | Electrical Conductivity Annealed at 0.040" % IACS | Properties at 0.10 inch 0.2% Yield Strength ksi | Tensile Strength ksi | Tensile Elong. % | Longitudinal MBR/t | Transverse MBR/t |
|---|---|---|---|---|---|---|---|
| 13 | 4.8 | 81.7 | 81 | 83 | 1.5 | 1.6 | 1.6 |

Figure 3:
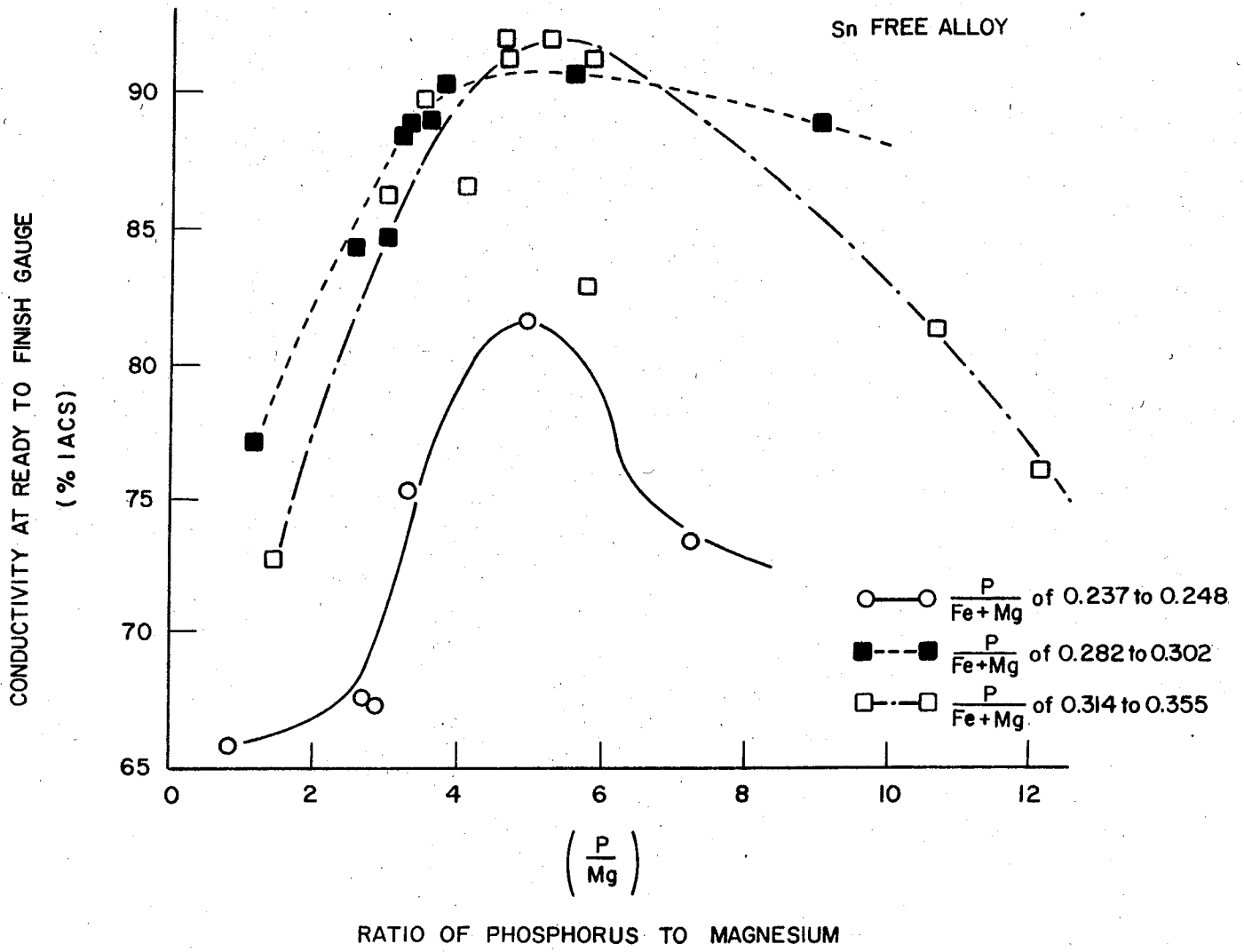
FIG. 3 is a graph showing the relationship between conductivity and the ratio of phosphorus to magnesium for a tin free alloy.
Figure 4:
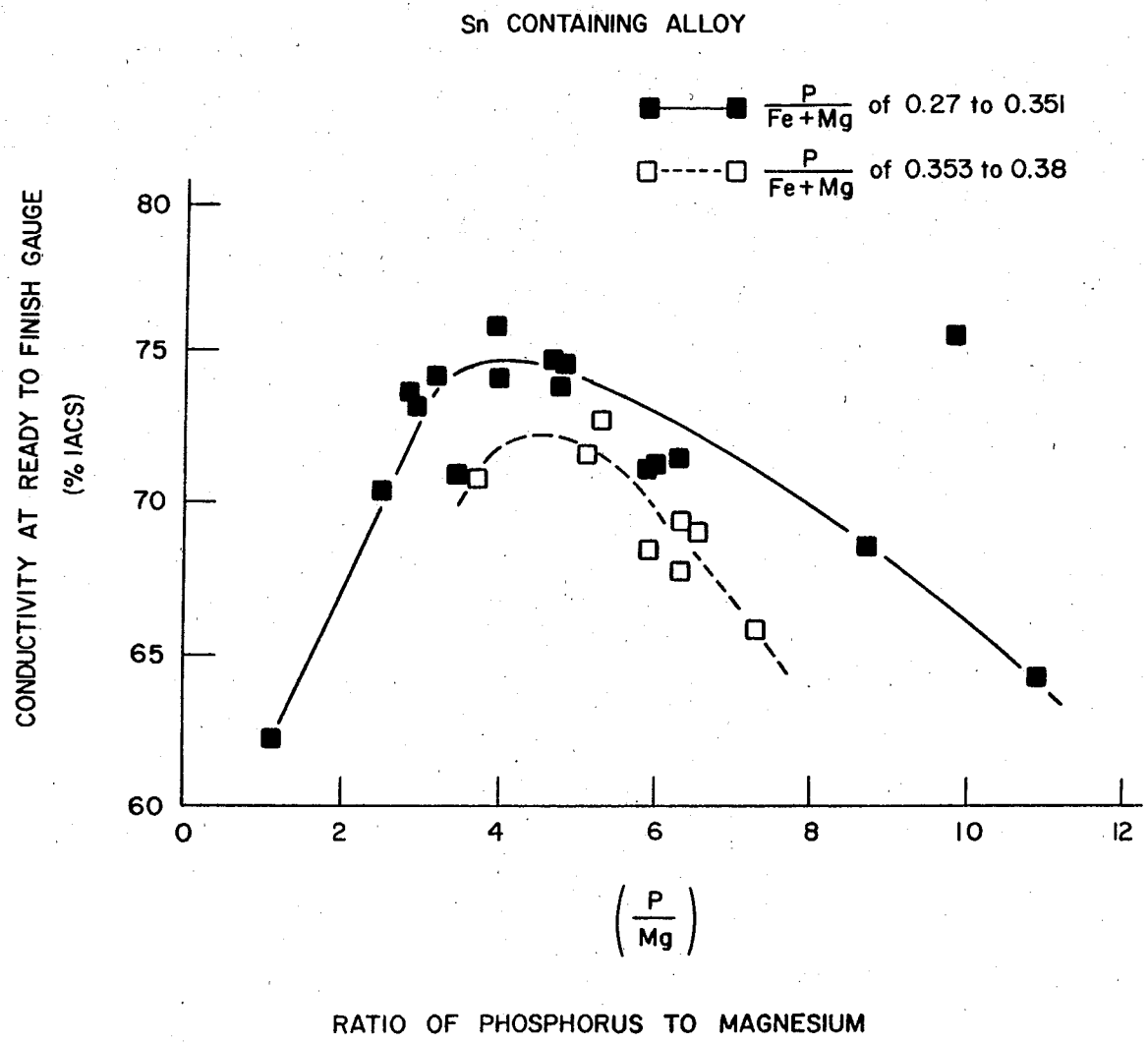
FIG. 4 is a graph showing the relationship between conductivity and the ratio of phosphorus to magnesium for a tin containing alloy.

Referring now to FIGS. 3 and 4, a series of curves are shown comparing electrical conductivity with the ratio of phosphorus to magnesium for a series of alloys both tin containing and tin free. Each curve is based on data points for alloys within predetermined ranges of the ratio of phosphorus to total content of phosphide formers. The alloys were processed in accordance with this invention as previously described. Some of the data points are based on alloy samples processed as in Example I, while other data points are based on alloy samples taken from commercial scale ingots processed in accordance with this invention.

Referring to FIGS. 3 and 4, it is apparent that the ratio of phosphorus to magnesium is in every sense critical in accordance with this invention and should preferably be at least 2.5. It is also apparent from a consideration of the figures that there is an interrelationship between the phosphorus to magnesium ratio and the ratio of phosphorus to total content of phosphide formers for these alloys. For example, referring to FIG. 3, at the low end of the phosphorus to total phosphide former ratio, which is outside the preferred limits of this invention, the acceptable phosphorus to magnesium ratios preferably fall within a very narrow range of about 2.5 to 6. The other curves in FIG. 3 are for phosphorus to total phosphorus ratios within the preferred range and as to those alloys, the permissible limits for phosphorus to magnesium are much broader, rendering the alloys less sensitive to variations in phosphorus to magnesium ratio.

Referring to FIG. 4, the effect of the phosphorus to total phosphide former ratio is also shown. It appears that the upper end of the preferred phosphorus to total phosphide former ratio range results in a somewhat narrower range of acceptable phosphorus to magnesium ratios.

It is apparent from a consideration of FIGS. 3 and 4 that the phosphorus to magnesium ratio should preferably be at least 2.5. Maintaining such a ratio within the range of 3 to 6 should render the alloy less sensitive to the effects of the phosphorus to total phosphide former ratio. Within the preferred limits of the phosphorus to total phosphide former ratio the ratio of phosphorus to magnesium should preferably be from 2.5 to 8 and most preferably 3 to 6.

EXAMPLE VI

This examples compares alloys with various ratios of phosphorus to total phosphide formers (P/Me). The alloys are listed in previous examples except Alloy 15 which is Cu—1.12%Fe—0.11%Mg—0.30%P and which was processed as in Example I. Conductivity was measured at 0.040" gauge.

Table 6 compares conductivity, yield strength and bend formability as a function of this ratio. The results show that conductivity decreases as the ratio increases above 0.32 and as the ratio decreases toward 0.24.

TABLE 6

| Alloy | P/Me Ratio | Electrical Conductivity Annealed at 0.040" % IACS | 0.2% Yield Strength ksi | Longitudinal MBR/t | Transverse MBR/t |
|---|---|---|---|---|---|
| 14 | 0.32 | 72.2 | 79 | 1.6 | 1.6 |
| 5 | 0.30 | 78.8 | 80 | 1.6 | 1.6 |
| 1 | 0.28 | 84.4 | 75 | 1.2 | 1.6 |
| 6 | 0.26 | 76.2 | 76 | 1.6 | 1.6 |
| 13 | 0.25 | 81.7 | 81 | 1.6 | 1.6 |
| 4 | 0.24 | 84.7 | 77 | 1.6 | 1.6 |
| 15 | 0.21 | 64.9 | 84 | 1.6 | 1.6 |

While the alloys of the present invention may also contain other elements and impurities which do not substantially degrade their properties, it is preferred that elements such as silicon, aluminum and chromium not be included except as incidental impurities.

EXAMPLE VII

Figure 5:
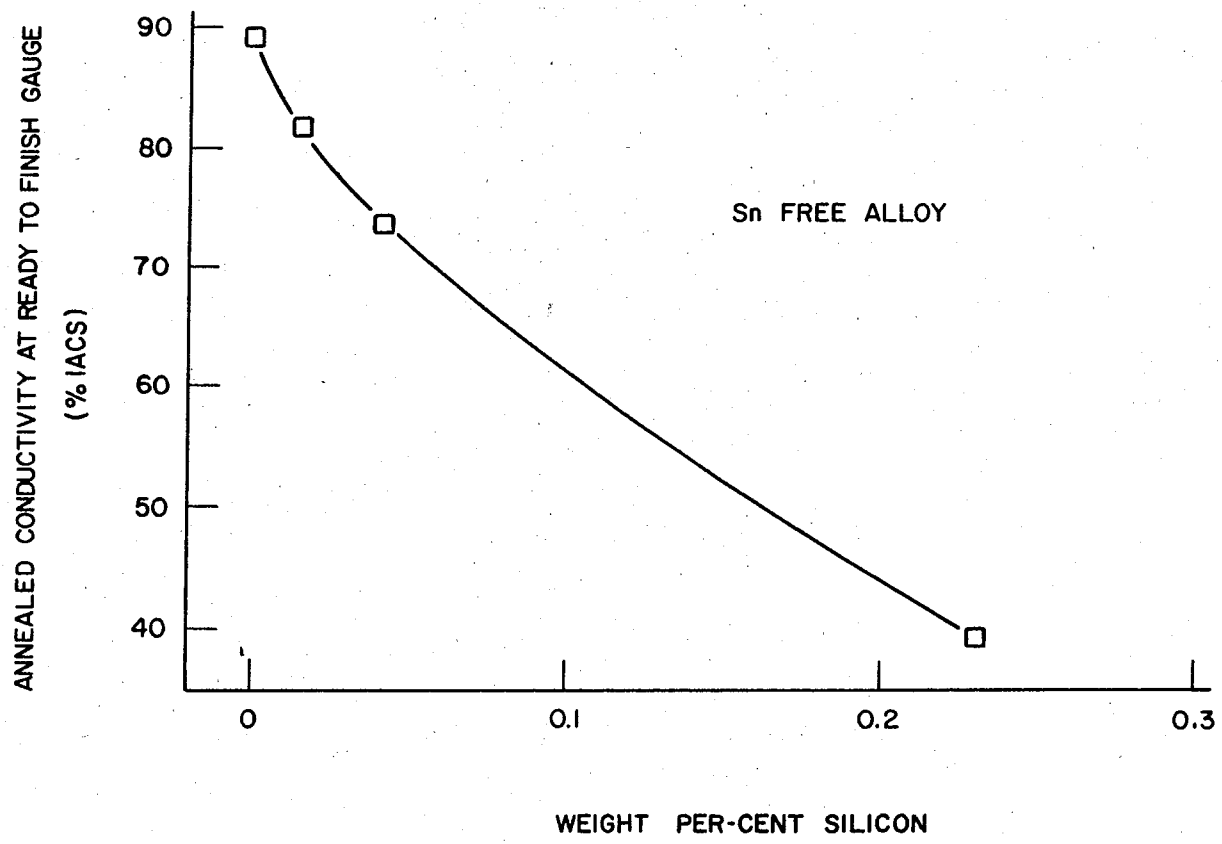
FIG. 5 is a graph showing the relationship between conductivity and silicon content for alloys of this invention.

A series of alloys having the compositions set forth in Table VII were processed as in Example I and their conductivities were measured at RF gauge which is the annealed gauge prior to the final reduction. The alloys set forth in Table VII have varying silicon contents. The results are plotted in FIG. 5 as a comparison of annealed conductivity versus silicon content. It is apparent from a consideration of FIG. 5 that silicon has a very negative effect on electrical conductivity and, therefore, should be avoided except as an incidental impurity.

TABLE VII

SILICON EFFECT ON Cu—Fe—Mg—P ALLOYS

| Alloy | Fe | Mg | P | Si | Me/P | RF Ga. % IACS |
|---|---|---|---|---|---|---|
| A | 0.69 | 0.053 | 0.180 | | 4.13 | 89.6 |
| B | 0.63 | 0.038 | 0.173 | 0.014 | 3.86 | 80.9 |
| C | 0.66 | 0.043 | 0.175 | 0.041 | 4.02 | 73.4 |
| D | 01.06 | 0.12 | 0.36 | 0.23 | 3.28 | 39.6 |

The alloys in accordance with this invention, which do not contain tin and, therefore, have the highest conductivity have particular application as semiconductor lead frame materials. The alloys of this invention containing tin and which consequently have a higher strength at somewhat reduced conductivity are particularly well adapted for electrical connector applications.

Referring again to FIG. 1, it is apparent that for essentially tin free alloys the broadest range of the phosphorus to total content of phosphide formr ratio will achieve about 70% IACS or above electrical conductivity. Similarly, the preferred limits for that ratio in the tin free embodiment will achieve about 80% IACS or above. With respect to the tin containing alternative embodiment of this invention the broad limits for this ratio will achieve about 60% IACS or above. The preferred limits for this embodiment would achieve about 70% IACS or above and the most preferred limits would achieve about 72% IACS or above.

Figure 6:
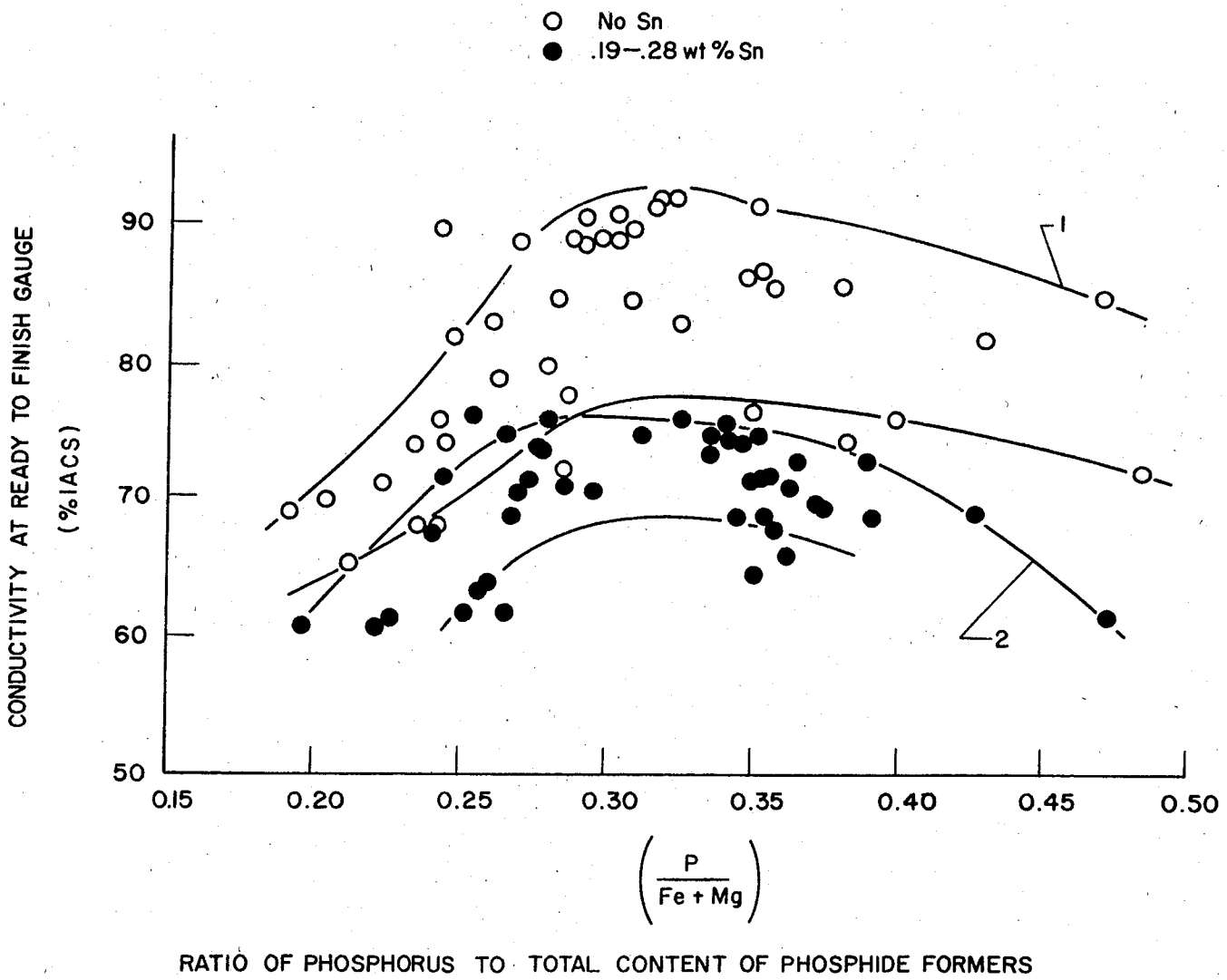
FIG. 6 is a graph showing the relationship between conductivity and the ratio of phosphorus to total content of phosphide formers including an increased number of data points as compared to FIG. 1.

FIG. 6 is a revised version of the graph presented in FIG. 1. In FIG. 6, a larger number of data points have been generated based on a series of alloys processed in accordance with Example I or taken from a commercial scale ingot processed in accordance with this invention. A comparison of FIG. 1 and FIG. 6 shows that both curves 1 and 2 represent a band of results. The added data presented in FIG. 6 does not change the appropriate ranges of phosphorus to total phosphide former ratios as in accordance with this invention although in some instances it may be possible to extend the lower limit for that range for the tin containing alloy to 0.22 based upon the additional data. The bands 1 and 2 in FIG. 6 arise because of a wide range of phosphorus to magnesium ratios for the alloys shown. Control of the phosphorus to magnesium ratio within the preferred limits of this invention should yield results toward the upper portion of the bands.

As used herein, the term "Yield Strength" refers to the strength measured at 0.2% offset. The term "Tensile Strength" refers to the ultimate tensile strength. Elongation in accordance with this invention are measured in a 2" gauge length. The term "ksi" is an abbreviation for "thousands of pounds per square inch". The commercial copper alloy designations set forth in this application comprise standard designations of the Copper Development Association Incorporated, 405 Lexington Avenue, New York, N.Y. 10017.

The patents and publications set forth in this specification are intended to be incorporated by reference herein.

It is apparent that there has been provided in accordance with this invention copper alloys having an improved combination of strength and conductivity which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A copper base alloy having a combination of high strength and high conductivity consisting essentially of from about 0.3 to about 1.6% by weight iron, with up to one-half the iron content being replaced by an element selected from the group consisting of nickel, manganese, cobalt and mixtures thereof; from about 0.01 to about 0.20% by weight magnesium; from about 0.10 to about 0.40% by weight phosphorus; up to about 0.5% by weight of an element selected from the group consisting of tin, antimony, and mixtures thereof; and the balance copper; with the proviso that the phosphorus to magnesium ratio comprises at least about 2.5 and that the ratio of phosphorus to the total content of phosphide formers (magnesium+iron+nickel+manganese+cobalt) ranges from about 0.22 to about 0.49.

2. A copper base alloy as in claim 1 wherein said iron content is from at least about 0.35% to about 1.6% by weight.

3. A copper base alloy as in claim 1 wherein said alloy consists essentially of from about 0.5 to about 1.0% by weight iron, with up to one-half the iron content being replaced by an element selected from the group consisting of nickel, manganese, cobalt and mixtures thereof; from about 0.15 to about 0.25% by weight phosphorus; from about 0.02 to about 0.1% by weight magnesium; up to about 0.35% by weight of an element selected from the group consisting of tin, antimony, and mixtures thereof; and the balance copper; with the proviso that the phosphorus to magnesium ratio ranges from about 2.5 to about 8.0 and that the ratio of phosphorus to the total content of phosphide formers ranges from about 0.25 to about 0.44.

4. A copper base alloy as in claim 1 wherein tin is present in an effective amount for increasing the strength of the alloy up to about 0.4% by weight and with the proviso that the ratio of phosphorus to the total content of phosphide formers ranges from about 0.22 to about 0.48.

5. A copper base alloy as in claim 4 wherein said ratio of phosphorus to the total content of phosphide formers ranges from about 0.22 to about 0.48.

6. A copper base alloy as in claim 3 wherein tin is present in an amount from 0.05 to about 0.35% by weight and with the proviso that the ratio of phosphorus to the total content of the phosphide formers ranges from about 0.27 to about 0.39.

7. A copper base alloy as in claims 1, 2 or 3 comprising a lead frame.

8. A copper base alloy as in claims 1, 2 or 3 which is essentially free of silicon.

9. A copper base alloy as in claims 1, 2 or 3 which is essentially free of silicon, aluminum and chromium.

10. A copper base alloy as in claims 1 or 4 wherein said alloy contains a mixture of phosphides comprising magnesium phosphide particles and phosphide particles of iron with or without an element selected from the group consisting of nickel, manganese, cobalt or mixtures thereof.

11. A copper base alloy as in claims 1 or 4 wherein the microstructure of the alloy consists essentially of some large 1 to 3 micron phosphide particles and a uniform dispersion of fine phosphide particles of less than about 0.5 microns in size.

12. A copper base alloy as in claims 4, 5 or 6 comprising an electrical connector.

13. A copper base alloy as in claim 1 wherein said ratio of phosphorus to magnesium ranges from about 3.0 to about 6.0.

14. A process for making a copper base alloy comprising:

providing a copper base alloy consisting essentially of from about 0.3 to about 1.6% by weight iron, with up to one-half the iron content being replaced by an element selected from the group consisting of nickel, manganese, cobalt and mixtures thereof; from about 0.01 to about 0.20% by weight magnesium; from about 0.10 to about 0.40% by weight phosphorus; up to about 0.5% by weight of an element selected from the group consisting of tin, antimony, and mixtures thereof; and the balance copper; with the proviso that the phosphorus to magnesium ratio comprises at least about 2.5 and that the ratio of phosphorus to the total content of phosphide formers (magnesium+iron+nickel+-manganese+cobalt) ranges from about 0.22 to about 0.49;

hot working said alloy from a starting temperature of from about 850° to about 980° C. to a desired gauge;

cold working said alloy from about 10 to about 90%; and annealing said alloy at a temperature of from about 400° C. to about 800° C. for an effective period of time to soften said alloy up to about 6 hours.

15. A process as in claim 14 wherein said alloy is further cold worked from about 10 to about 90% and then annealed at a temperature of from about 350° to about 550° C.

16. A process as in claim 14 wherein said annealed alloy is further cold worked from about 20 to about 80% to provide a desired temper.

17. A process as in claim 14 wherein said iron content is from at least about 0.35% to about 1.6% by weight.

18. A process as in claims 14 or 15 wherein said alloy consists essentially of from about 0.5 to about 1.0% by weight iron, with up to one-half the iron content being replaced by an element selected from the group consisting of nickel, manganese, cobalt and mixtures thereof; from about 0.15 to about 0.25% by weight phosphorus; from about 0.02 to about 0.1% by weight magnesium; up to about 0.35% by weight of an element selected from the group consisting of tin, antimony, and mixtures thereof; and the balance copper; with the proviso that the phosphorus to magnesium ratio ranges from about 2.5 to about 8.0 and that the ratio of phosphorus to the total content of phosphide formers ranges from about 0.25 to about 0.44.

19. A process as in claims 14 or 15 wherein tin is present in an effective amount for increasing the strength of the alloy up to about 0.4% by weight and with the proviso that the ratio of phosphorus to the total content of phosphide formers is from about 0.22 to about 0.48.

20. A process as in claims 14 or 15 wherein said ratio of phosphorus to the total content of phosphide formers is from about 0.24 to about 0.48.

21. A process as in claims 14 or 15 wherein tin is present in an amount from 0.05 to about 0.35% by weight and with the proviso that the ratio of phosphorus to the total content of phosphide formers ranges from about 0.27 to about 0.39.

22. A process as in claim 14 for providing an alloy having improved strength wherein said annealing step comprises an anneal for partial recrystallization and wherein said anneal is carried out at a temperature of from about 425° to about 500° C. so as to provide from about 10 to about 80% recrystallization of said alloy.

23. A process as in claim 22 wherein said alloy is further cold worked from about 10 to about 90% and then annealed to provide partial recrystallization of from about 10 to about 80% recrystallization of said alloy at a temperature of from about 375° to about 475° C.

24. A process as in claim 16 further including the step of forming said alloy into a semiconductor lead frame.

25. A process as in claim 16 wherein tin is present in an effective amount for increasing the strength of the alloy up to about 0.4% by weight and with the proviso that the ratio of phosphorus to the total content of phosphide formers is from about 0.24 to about 0.48 and further including the step of forming said alloy into an electrical connector.

* * * * *